United States Patent [19]

Colamussi et al.

[11] Patent Number: 4,774,797

[45] Date of Patent: Oct. 4, 1988

[54] METHOD OF WRAPPING VARIOUS PRODUCTS IN PACKAGING MADE FROM SHEET MATERIAL, A DEVICE FOR WORKING THE METHOD, AND PACKAGING THUS OBTAINED

[75] Inventors: Arturo Colamussi, Ferrara; Andrea Melchiorri, Pontelagoscuro Fe, both of Italy

[73] Assignee: Azionaria Costruzioni/Macchine Automatiche A.C.M.A. S.p.A., Bologna, Italy

[21] Appl. No.: 59,975

[22] Filed: Jun. 9, 1987

[30] Foreign Application Priority Data

Jun. 23, 1986 [IT] Italy ..... 3446 A/86
Oct. 31, 1986 [IT] Italy ..... 3560 A/86

[51] Int. Cl.[4] ..... B65B 9/08

[52] U.S. Cl. ..... 53/459; 53/468; 53/562; 53/568

[58] Field of Search ..... 53/459, 468, 455, 562, 53/568, 384

[56] References Cited

U.S. PATENT DOCUMENTS 3,344,576 10/1967 Cloud et al. ..... 53/459 X
3,599,388 8/1971 Feingold ..... 53/459 X
3,821,873 7/1974 Benner, Jr. et al. ..... 53/562 X
3,975,888 8/1976 Jones ..... 53/562 X
4,232,504 11/1980 Dieterlen et al. ..... 53/562 X

*Primary Examiner*—James F. Coan
*Attorney, Agent, or Firm*—Guido Modiano; Albert Josif

[57] ABSTRACT

The invention relates to a method of wrapping various products in packaging obtained from a strip. In the method, the strip is longitudinally folded along its center so as to form two longitudinal portions which are longitudinally coupled. The portions are then joined along transverse junction lines which define compartments having upwardly open mouths for inserting material. The compartments are then separated at the transverse junction lines, thus obtaining a set of independent bags which remain joined together at lateral areas near the mouth. The resulting bags are suspended from a conveyor travelling along a closed path in a loop. According to the invention, the path travelled by the bags is inside the path of the conveyor so that opposite corners of the bag mouths are brought together and consequently loosen the borders bounding the mouth so that metering means can be inserted along a circular portion of the path of the conveyor so that a preset amount of material can be discharged into the bags. After the metering means has been removed, the bags are closed and separated from one another. The invention also relates to a device for working the aforementioned method, and the resulting packaging.

19 Claims, 5 Drawing Sheets

A
E
D 43
40
41
61
62
58
59
56
60
54
57
50
55
51
48
49
45
44
47
37
52
53
46
53
52
32
42
19
34
30
15
24
74
22
29

METHOD OF WRAPPING VARIOUS PRODUCTS IN PACKAGING MADE FROM SHEET MATERIAL, A DEVICE FOR WORKING THE METHOD, AND PACKAGING THUS OBTAINED

BACKGROUND OF THE INVENTION

The invention relates to a method of wrapping various products in packaging made of strip or sheet material, a device for working the method, and the resulting packaging. The packaged products can be in powder form or individual articles such as packets of cigarettes, bars of chocolate or fruit. During the rest of the description the sheet material will be referred to as a thermo-weldable film of plastics, but the invention is also applicable to composite materials made up of a sheet of paper or metal (aluminum) coated on one or both sides with a layer of plastic material or other substance, e.g. adhesive or size, which can be activated by heat, pressure or a solvent, to produce a joint when brought into contact. Use may also be made of a sheet of paper coated with substances activated by heat, pressure or solvent but only at the places to be joined.

In the packaging sector, as is known, some lowprice products such as powdered detergents are sold packed in boxes which have various sizes and dimensions and thus appreciably affect the final cost of the product.

It has therefore been found necessary to pack these products more economically, to meet the requirements of markets where the supply of box packaging material is scarse or where consumers have to be provided with a very cheap product by drastically reducing the cost of the packaging as a proportion of the final cost.

SUMMARY OF THE INVENTION

The technical aim of the invention, therefore, is to meet the requirements of this particular class of consumers by devising a method of obtaining cheaper packaging of the aforementioned kinds of products, with greater productivity.

This object is achieved by means of a process characterized in that it comprises the steps of feeding a strip of packing lying in a vertical plane, the strip comprising two adjacent longitudinal portions connected along a bottom edge and along equidistant transverse lines defining a set of contiguous compartments having a mouth along the top longitudinal edge, forming at least one eyelet along each transverse junction line at a preset distance near the edge of the mouth, arranging a conveyor to move along a closed path in a loop comprising an arc of a circle, providing said conveyor with suspension means engaging said eyelets so that the compartments travel along a path inside the path of the conveyor at least along said arc to cause adjacent suspension means to move together and the mouths of the compartments along said arc to widen, inserting batches of products through said widened mouths into said compartments along said arc by metering means disposed concentrically along said arc, and finally closing the compartments.

In an advantageous embodiment of the method, the compartments are partially separated at transverse junction lines by separation lines extending from the bottom edge to near the eyelets, thus obtaining bags joined at areas comprising the eyelets.

In another advantageous embodiment of the method, the longitudinal portions are formed by longitudinally folding in half the packaging strip so as to obtain two portions joined along a bottom folded edge. A concertina part is formed along the folded edge and constitutes a base enabling better use of the capacity of the bags, which can be held erect when filled.

Another object of the invention is to construct a device for working the aforementioned method characterized in that it comprises means for conveying a packaging strip in a vertical plane, the strip comprising two longitudinal portions joined along the bottom edge and along transverse lines which define a set of adjacent compartments having mouths along the upper edge, means for forming at least one eyelet along each transverse junction line at a preset distance near said upper edge, a conveyor travelling along a closed path in a loop comprising a rectilinear portion and an arc of circle and provided with means for suspending the compartments at said transverse lines and disposed so that the compartments travel along the path inside the path of the conveyor at least along said arc, so that adjacent suspension means are brought together and the mouths of the compartments along said arc are widened, metering means disposed concentrically along said arc and adapted to insert batches of product into the compartments along said arc, and means for closing the compartments.

The invention also relates to packaging obtained by the aforementioned method and defined in the claims.

BRIEF DESCRIPTION OF THE DRAWINGS

Other advantages and characteristics of the invention will be clear from the following description of a preferred embodiment, illustrated by way of non-limitative example in the accompanying drawings in which.

DESCRIPTION OF THE PREFERRED EMBODIMENTS

Figures 1, 2:
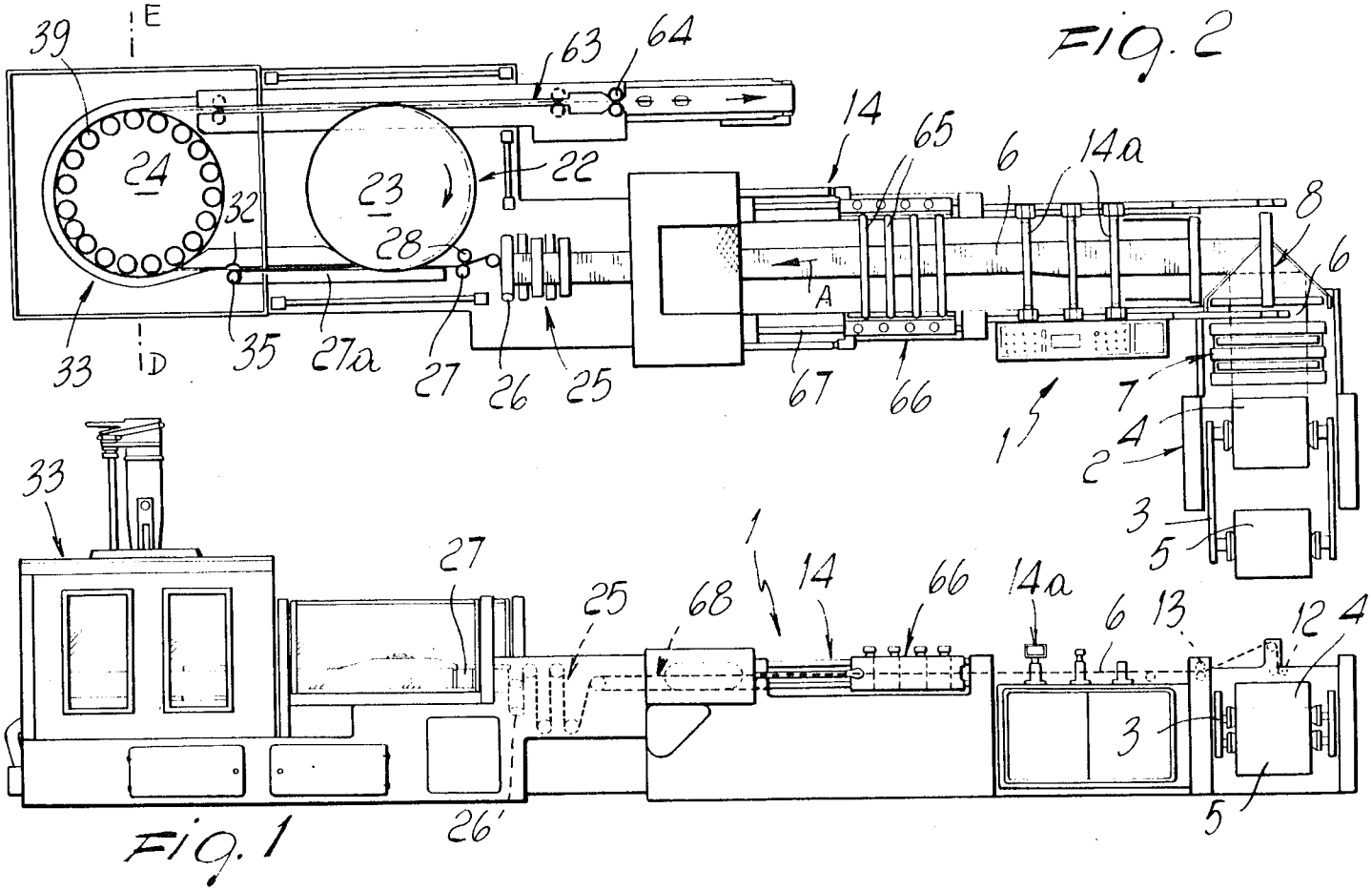
FIG. 1 is a diagrammatic view in elevation of a device for wrapping pulverulent products in a thermo-weldable film of plastics according to the invention.
FIG. 2 is a plan view of the device in FIG. 1.
Figure 3:
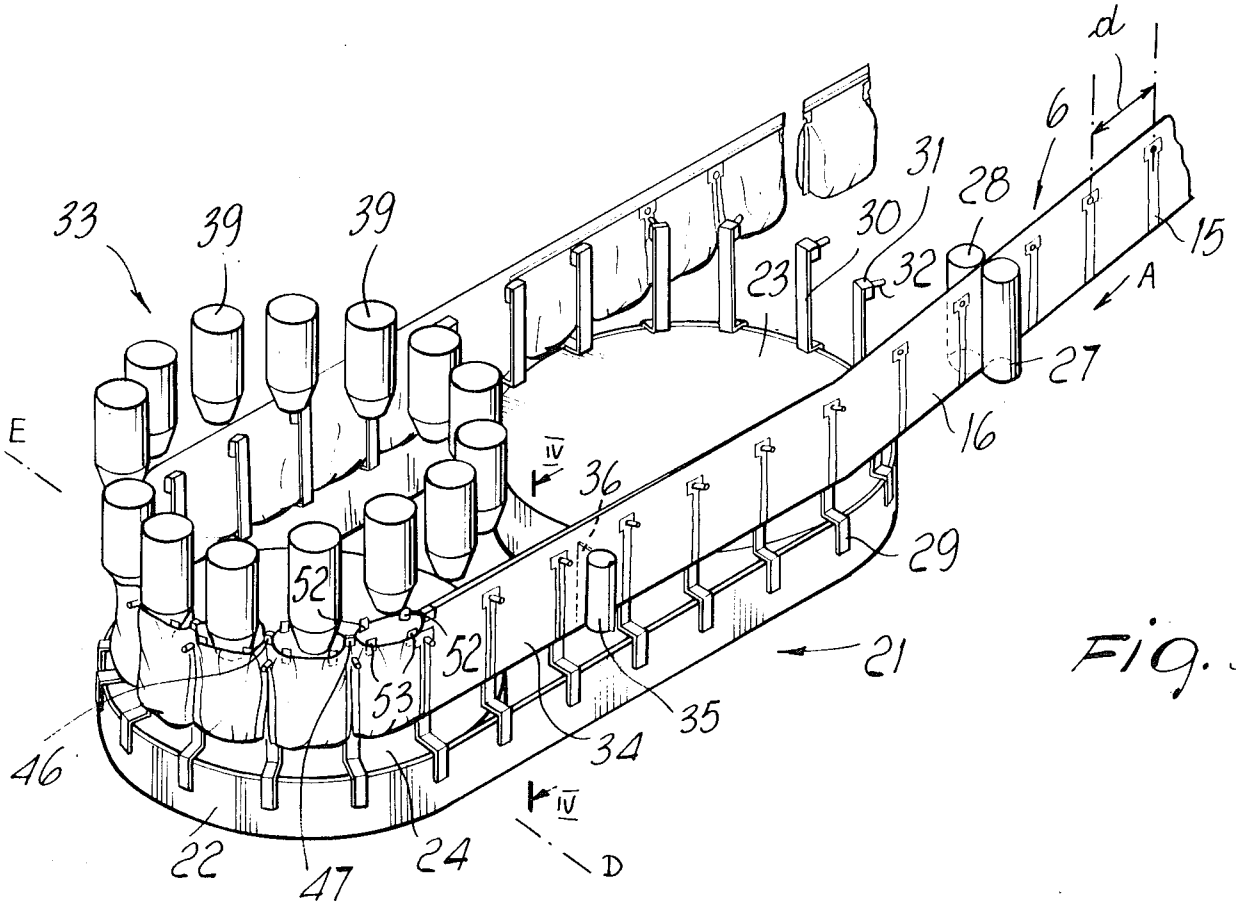
FIG. 3 is a perspective view illustrating the operation of the device in FIG. 2.

With reference to FIGS. 1 and 2 the device comprises a base 1 having two uprights 2 on which a frame 3 is supported so as to be rotatable around a horizontal axis. A spool 4 holding a strip of thermo-weldable plastic for manufacture of packaging is rotatably mounted on one side of frame 3. The other side of frame 3 bears a reserve spool 5 from which material is taken when spool 4 is empty.

A strip 6 unwound from spool 4 is conveyed through a guide means comprising a set of compensating rollers 7 for supplying a reserve during spool changing and for compensating any variations in the tension on strip 6 resulting e.g. from fluctuations in the speed with which the strip is drawn off.

Figure 4:
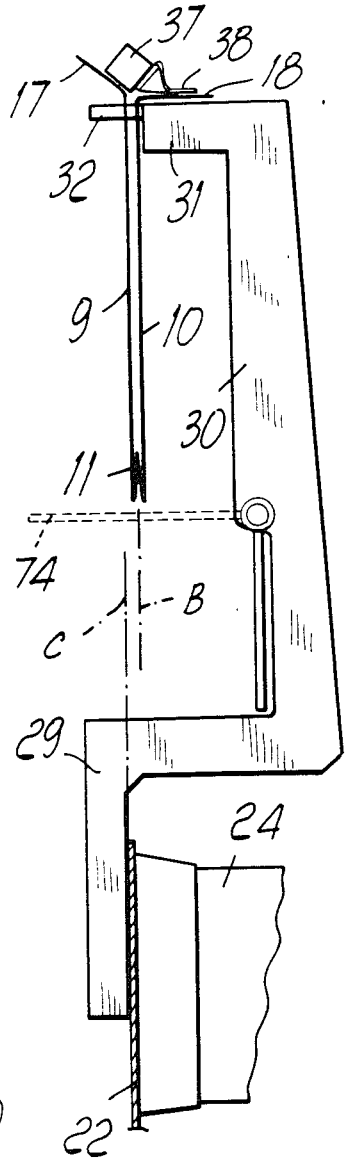
FIG. 4 shows means for holding the bags in the plane of section IV—IV of FIG. 3.

Folding means 8 disposed downstream of means 7 fold the strip 6 longitudinally along its centre, thus obtaining two adjacent longitudinal portions 9, 10 which lie in a horizontal plane and which, as will be shown hereinafter, during the filling operation are disposed in vertical planes with the folded edge downwards. Means 8 are preferably designed so as to produce a so-called concertina base 11 (se FIG. 4).

After leaving means 8, strip 6 travels through pairs of guide rollers 12, 13 towards a device 14 in which the two portions 9, 10 are joined together along weld lines 15, which are transverse to the direction of advance A of the strip.

Figure 5:
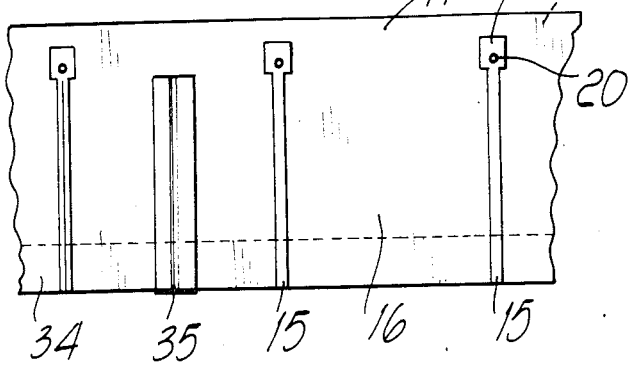
FIG. 5 is a view in side elevation of the resulting bags.

As shown in FIG. 5, the transverse welding lines 15 define a set of adjacent compartments 16 whose top borders 17, 18 bound a mouth through which material is inserted into the compartments for packaging. Lines 15 are shaped so that portions 9, 10 are welded together at a height extending from base 11 up to a preset distance from the top edge, thus leaving the two top borders 17 and 18 free. In one specific position, the top edge of the welding lines has a widened area 19 formed with an aperture or eyelet 20 by punch means 14*a* combined with device 14. In operation, device 14 accompanies the strip towards a conveyor 21 comprising a flexible loop 22 made e.g. of steel strip and wound around a pair of large-diameter pulleys 23, 24 lying in a horizontal plane. An additional guide means 25 disposed between the welding device 14 and the conveyor belt 21 comprises compensating rollers 26 and other rollers 27, 28 disposed so as to position and guide the strip in a vertical plane during its advance. Brackets 29 secured to loop 22 extend inwards and bear respective columns 30 ending in blocks 31. Blocks 31 project outwards and terminate in pins 32 for engaging in the eyelets 20 and acting as suspension means.

By means of eyelets 20, strip 6 is suspended from pins 32 and conveyed under a metering head 33 where compartments 16 are filled with batches of product. However, before coming under the metering head 33, strip 6 is cut at a welding lines 15 so as to obtain independent bags 34. The cutting lines extend to near eyelets 20, thus obtaining a set of bags 34 joined at the wide portions 19. The strips are cut at the welding lines 15 by a rotary knife 35 positioned in the path of the tape between wheels 23 and 24 and cooperating with a stationary counter-knife 36.

Before following the circular path of the metering head 33, the top borders 17, 18 are opened out in a V by a folding means 37 (FIG. 4) which has a shaped tongue 38 for subsequently turning over the inner border 18 through 90°.

Figure 9:
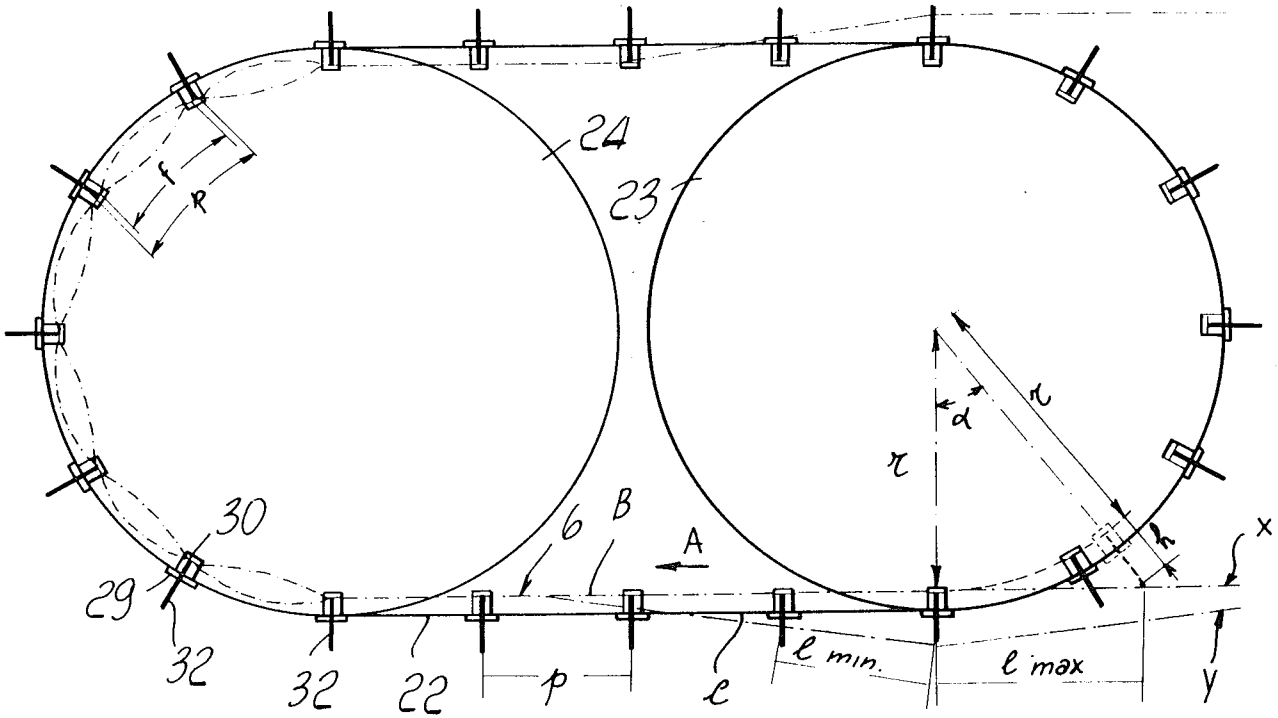
FIG. 9 is a diagrammatic plan view of the conveyor.

One main advantage of the invention is that the vertical plane B of bags 34 along the path of the conveyor, more particularly along the circular part under the metering head 29, is slightly offset internally with respect to the plane C of the flexible loop 22. Consequently (compare FIG. 9) when bags 34 travel along the circular part the pins 32 come together and consequently loosen the borders 17, 18 bounding the mouth at the top of the bags. The result, as will be seen more clearly hereinafter, is opening of the mouth and that a batch of product can be inserted into the bags.

The pitch of the pins 32 at the plane C is indicated by "p", while the pitch of said pins at the plane B and along the half-circle in which the loop 22 is in contact with the wheel 24, is indicated by "f" and it is "f"<"p" owing to the internal path of blocks 31 with respect to plane C.

In order to insert pins 32 into eyelets 20, the pins have a length extending outside the loop 22 and the distance between eyelets 20 is made slightly greater than the distance between pins 32.

The insertion of the pins 32 at the output of the wheel 23 into the eyelets 20 of the tape requires particular attention.

Actually, the pitch "d" of the eyelets, on account of the working tolerances, of the elasticity of the tape and of the consequent elongation due to the drawing or traction force to which the same is subject, undergoes significant variations which may compromise the engagement of the pins 32 with the eyelets.

In order to ensure said engagement, it is provided that when a pin 32 has its free end in contact with the tape 6 (position indicated by broken lines in FIG. 9) the eyelet is in any case downstream thereof so as to satisfy the relation "d"<"$l_{max}$" where "$l_{max}$" is the distance between the point of tangence of the pin on the tape and the last eyelet already engaged by the preceding pin, which can be easily calculated if the distance "r" of the plane B from the center of the wheel 23 and the height "h" of the pins from the plane B are known.

During the arc of the circle "$\alpha$" (alpha) defined between said two positions, the end of the pin 32 traces a curved path which is greater than that traced by the eyelet 20, which allows the pin to approach the eyelet which precedes it.

However, in order to allow the pin 32 to reach the respective eyelet and engage therein, taking also into account the fact that the pin which traces the angle "$\alpha$" also pushes the packaging tape 2 outwards, from the position X to the position Y it is also necessary that "d">"$l_{min}$", where "$l_{min}$" is substantially equal to the length of the section of tape comprised between two pins along the rectilinear portion at the output of the wheel 23.

A guide 27*a* subsequently moves the compartments against blocks 31, i.e. along a path inside loop 22. To facilitate the step of transferring the bags to the pins 32, the path of bags 16 is slightly inclined with respect to the straight part of the loop 22.

The metering head 33 comprises a number of means 39 positioned along a circumference concentric with pulley 24. Means 39 have the same angular velocity as pulley 24 and each of them, along the semicircular path between the angular positions D and E where loop 22 is at a tangent to pulley 24, is vertically aligned above a respective bag borne by conveyor 21.

Figure 8:
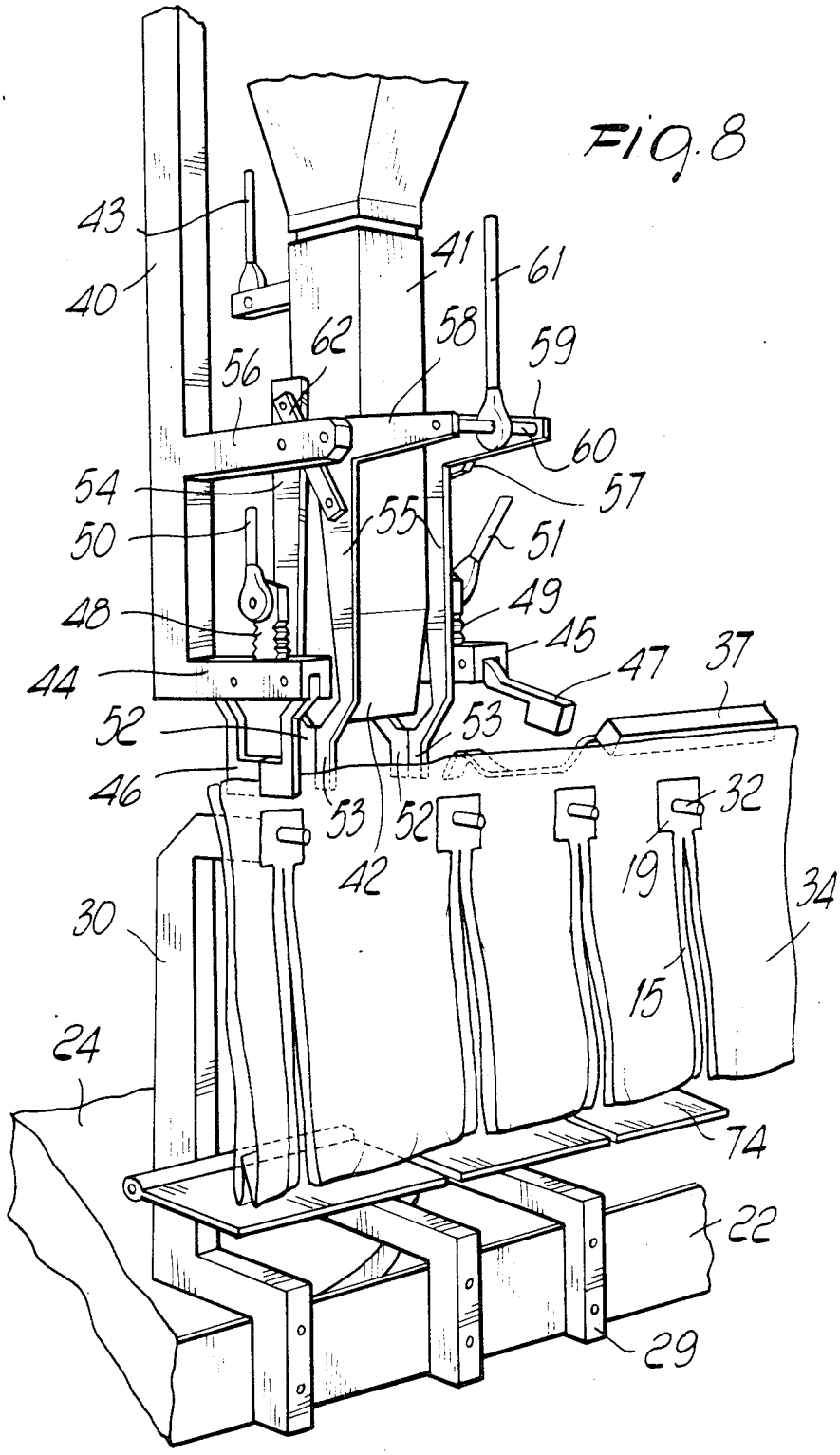
FIG. 8 is a perspective view of a metering means.

Each metering means (see FIG. 8) comprises a frame 40 rotating integrally with pulley 24 and bearing a vertically movable hopper 41 terminating at the bottom in a discharge funnel 42 which is raised and lowered by actuating means 43 controlled e.g. by a stationary cam.

More particularly, each metering means remains raised along the part from E to D, whereas after leaving the angular position D, each hopper 41 is lowered and engages in the respective bag and then raised before reaching position E. In the lower or bag-engaging position, a suitable actuating means discharges a preset quantity of product.

Frame 40 has two lower arms 44, 45 to which pairs of levers 46, 47 are articulated each constituting a gripper for gripping the top borders of bags 34 at the opposite ends of the mouth above the area 19, when each metering means is disposed above the respective bag.

Grippers 46, 47 have toothed sectors engaging respective racks 48,49 vertically movable by actuating means 50, 51. For the purpose of inserting funnel 42 into the bag mouths during the descending travel, opening-out elements are inserted between borders 17, 18 and then moved apart so as to widen the mouth sufficiently to receive funnel 42. The opening-out elements comprise two pairs of lugs 52, 53 each ending at the bottom in a respective pair of levers 54 and 55. Levers 54, 55 are jointed to projections 56, 57 from frame 40 above arms 44, 45.

Levers 55 have extensions 59, 58 projecting forward and connected at their ends by a bar 60 actuated by means 61.

Links 62 (only one of which is shown in the drawing) are pivoted to levers 55 and form a joint between them and upward prolongations of levers 54. As will be clear from the preceding, when means 61 are actuated, levers 54, 55 and lugs 52, 53 oscillate in opposite directions and thus widen the mouths of bags 34 after penetrating between borders 17 and 18.

The described device operates as follows:

Tape 6 is unwound from spool 4 and folded longitudinally at its centre by means 8 and guided through device 14, where the transverse welds 15 and eyelets 20 are formed so that strip 6 can be suspended from pins 32 of conveyor 21.

During the travel between pulleys 23 and 24, bags 34 are separated by knives 35 and 36. Immediately downstream of knives 35 and 36, the top adjacent borders 17, 18 of the strip are folded into a V by means 38. The inner border 18, as stated, is folded through more than 90° by tongue 38. The purpose of this extra folding is to enable the pairs of lugs 52, 53 associated with the various metering devices to move between borders 17 and 18 during the rotation of head 33, without interfering with the inner border 18 as they would do if the border remained raised. Note that during this step the lugs remain at the same height in contrast to hopper 41, which is moved vertically.

When bags 34 tangentially engage the metering head, at a suitable command the grippers 46, 47 are successively closed and grip the bags at the ends remote from their mouths.

Bags 34 are filled during the angular rotation between position D and the diametrically opposite position E where strip 6 leaves the metering head. More particularly the bag mouths are first widened by opening out the pairs of lugs 52, 53 and then the hoppers 41 are lowered and inserted from above into the bags.

Note that the widening of the bag mouths is not due to the elasticity of the material but to the loosening of the borders 17, 18 held between grippers 46, 47 during the circular motion between position D and E since the inner path followed by bags 34 is shorter than the outer path of loop 22 of conveyor 21.

When funnel 42 has entered the respective bag 34, a portion of product is discharged into the bag.

Before the bags leave the metering head, hoppers 41 rise and grippers 46, 47 open, enabling the bags to continue moving towards device 36, which welds the top borders 17, 18 and hermetically seals the bags.

Knives 64 then completely separate the bags by cutting the remaining joining portions at eyelets 20.

Note that when the bags leave the metering head, the loosened borders defining the mouths for introducing the product are pulled flat and drawn together before entering the welding device 63. Device 63 can therefore weld without producing creases or the like.

The invention can have numerous modifications and variants. In one embodiment, device 14 comprises welding bars 65 on opposite sides, between which the strip 6 advances. The bars are mounted on a carriage 66 driven on guides 67 in alternate steps corresponding to the direction of advance (direction A) and at the same speed as the advance of the tape, thus accompanying it when making transverse welds.

Advantageously the tape 6 is borne by a belt 68 which moves it to conveyor 21 after first travelling through guide means 25 and rollers 27, 28.

Eyelets 20 can be made by cutting means combined with the welding bars and actuated during the welding process.

Figure 6:
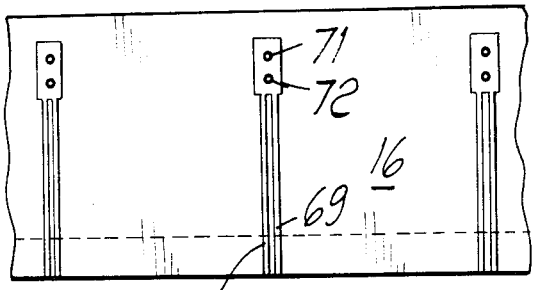
FIGS. 6 and 7 are views of two variant bags.

Advantageously (see FIG. 6) the transverse welding lines 15 each comprise a pair of adjacent lines 69, 70, between which the separation line is made by knives 35 and 36. Also, two superposed eyelets 71, 72 can be formed, the top eyelet 71 engaging the bearing pin 32 whereas the bottom eyelet 72 ensures that the bags are detached even when the cut made by the final knives 64 is not exactly aligned with the cut made by the knives 35 and 36.

Figure 7:
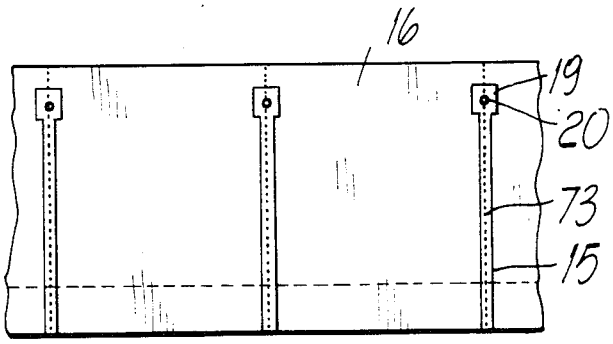

In a second variant, means are connected to the welding bars 65 for making a preliminary incision 73 at the transverse welds so as to mark a preferred line for parting the bags. In that case knives 35, 36 will be replaced by pressure means which break the pre-incised portion so that the bags are separated in the semicircular section where the metering device operates (see FIG. 7).

In another embodiment, the guide rollers 27, 28 can be motor-driven so that strip 6 can be accurately inserted on to pins 32 when there are appreciable variations in the axial distance between the apertures for bearing the bags. The drive will be adapted to increase or reduce the rated speed of the tape so as to align apertures 71 exactly with pins 32 when the film is loaded on to conveyor 21.

In another variant of the invention (see FIG. 4), columns 30 are connected to plates 74 adapted to serve as bearing surfaces below the bags after filling, thus reducing the force on the eyelets 20. The plates can be controlled by vibrating means for settling the product and thus improving the filling of the bags.

If the bags need to have a written indication of their contents, a centering device can be provided for centering the writing on each bag.

In another variant of the invention, instead of longitudinally folding a single strip along its centre, portions 9, 10 can be obtained from different spools. In that case an additional welding means will longitudinally weld the base. Note that owing to the concertina part 11, when the bags leave the welding device 63 after being separated by knives 64, they can stay erect and are thus more suitable for subsequent manipulation.

The basic inventive idea is also applicable to the case where strip 6, instead of being of thermo-weldable plastics, is a composite material comprising a strip of paper or metal (aluminum) having one or both surfaces covered with a layer of thermo-weldable plastics.

The device, if suitably molded, can also be used when strip 6 is a simple strip of paper. In that case, however, the longitudinal portions 9, 10 will be coated at the areas to be joined, with a layer activatable by a solvent, heat or pressure. The layer may already be present on strip 6 or may be applied by distributor means.

Obviously, the invention disclosed herein is susceptible to numerous modifications and adaptations, without departing from the purview of the instant inventive concept.

Furthermore, any materials, dimensions or shapes may be used according to requirements.

What is claimed is:

1. A method of wrapping various products in packaging made of sheet material, comprising the steps of feeding a strip of packaging lying in a vertical plane, the strip comprising two adjacent longitudinal portions, connected along a bottom edge and along equidistant transverse lines defining a set of contiguous compartments having a mouth along the top longitudinal edge, forming at least one eyelet along each transverse junction line at a preset distance near the edge of the mouth, arranging a conveyor to move along a closed path in a loop comprising an arc of a circle, providing said conveyor with suspension means engaging said eyelets so that the compartments travel along a path inside the path of the conveyor at least along said arc to cause adjacent suspension means to move together and the mouths of the compartments along said arc to widen, inserting batches of products through said widened mouths into the compartments along said arc by metering means disposed concentrically along said arc, and finally closing the compartments.

2. A method according to claim 1, wherein said two longitudinal portions are formed by folding a packaging strip longitudinally along its centre.

3. A method according to claim 1, wherein after the eyelets have been formed, the compartments are partially separated from one another at the transverse lines by separation lines so as to obtain bags joined at areas comprising said eyelets.

4. A method according to claim 3, wherein said two longitudinal portions are joined together along equidistant transverse lines extending from the lower edge defining said bottom edge up to a preset distance from the top edge so as to define compartments having a mouth bounded by the nonjoined borders of said portions.

5. A method according to claim 1, wherein the top ends of the transverse junction lines, at specified portions, have widened areas in which respective eyelets are formed.

6. A method according to claim 2, wherein the compartments are separable by pre-incision lines extending along said transverse lines from the bottom edge up to the top edge.

7. A method according to claim 1, wherein said transverse junction lines each comprise a pair of adjacent junction lines between which an intermediate cutting line is formed.

8. A method according to claim 1, wherein a concertina-like portion is formed along the central folding line of the strip.

9. A device for wrapping various products in packaging made of sheet material comprising means for conveying a strip of packaging in a vertical plane, the strip comprising two longitudinal portions joined along the bottom edge and along equidistant transverse junction lines defining a set of contiguous compartments having a mouth along the upper edge, means for forming at least one eyelet along each transverse junction line at a preset distance near said upper edge, a conveyor travelling along a closed path in a loop comprising a rectilinear portion and an arc of a circle and provided with means for suspending the compartments at said transverse lines and disposed so that the compartments travel along a path inside the path of the conveyor at least along said arc, so that adjacent suspension means are brought together and the mouths of the compartments along said arc are widened, metering means disposed concentrically along said arc and adapted to insert batches of product into the compartments along said arc, and means for closing the compartments.

10. A device according to claim 9, further comprising means for longitudinally folding the packaging strip at its centre in order to form said two longitudinal portions.

11. A device according to claim 9, further comprising means for partially separating the compartments at said transverse junction lines by means of separation lines extending from the folded edge to near the eyelets, so as to obtain bags joined together at areas comprising the eyelets.

12. A device according to claim 9, wherein the conveyor comprises a flexible loop made of steel strip and wound on a pair of horizontal pulleys, to said loop being secured equally spaced brackets from which respective columns vertically extend having upper ends bearing pins projecting outwards to engage the eyelets in the strip and carry it, the pins having a length such that their ends are outside the path of the conveyor and shaped so that the strip lies in a plane inside said path.

13. A device according to claim 9, wherein said metering means are disposed along a circumference concentric with the arc of the conveyor and are vertically movable between a raised position and a lowered position for engaging the compartments of the strip.

14. A device according to claim 12, wherein one of said pulleys defines said arc of a circle concentric to said metering means and the other pulley defines a second arc of circle tangential to said rectilinear portion, said eyelets having a mutual spacing which is slightly greater than that between two adjacent pins along said rectilinear portion and smaller than that between a pin at the tangential point of said rectilinear portion with said other pulley and the contact point of a next pin with the strip.

15. A device according to claim 9, further comprising gripping means adapted to grip the opposite ends of the mouths of the compartments, and opening-out means adapted to widen the mouths of the compartments to receive the metering means.

16. A device according to claim 15, wherein the opening-out means comprise pairs of lugs adapted to engage between the borders of the strip bounding the mouths so as to widen the mouths and insert the metering means into the compartments.

17. A device according to claim 9, wherein folding means adapted to fold the top borders of the strip in a V configuration and a folding means adapted to fold the inner border through 90° are disposed upstream of the metering means so that the opening-out lugs can engage between the borders.

18. A device according to claim 9, wherein vibrating means are provided for settling the product in the bags.

19. A device according to claim 9, further comprising a device for centering the printing on the compartments.

* * * * *